US008733058B2

(12) United States Patent
Ulgen

(10) Patent No.: US 8,733,058 B2
(45) Date of Patent: May 27, 2014

(54) BOAT CABIN CONSTRUCTION

(76) Inventor: Mehmet Nevres Ulgen, Istanbul (TR)

( * ) Notice: Subject to any disclaimer, the term of this patent is extended or adjusted under 35 U.S.C. 154(b) by 100 days.

(21) Appl. No.: 13/534,138

(22) Filed: Jun. 27, 2012

(65) Prior Publication Data

US 2014/0000501 A1 Jan. 2, 2014

(51) Int. Cl.
*E04H 12/00* (2006.01)

(52) U.S. Cl.
USPC ..... 52/648.1; 52/79.1; 52/483.1; 52/665; 114/71; 114/189

(58) Field of Classification Search
USPC ..... 52/79.1, 479, 483.1, 648.1, 664–667, 52/653.1, 655.1, 106; 114/71, 189, 65 R, 114/82–84
See application file for complete search history.

(56) References Cited

U.S. PATENT DOCUMENTS

| | | | | | |
|---|---|---|---|---|---|
| 3,813,841 | A * | 6/1974 | Tsurumi | ..... | 52/648.1 |
| 3,927,950 | A * | 12/1975 | Herrmann et al. | ..... | 403/346 |
| 4,821,481 | A * | 4/1989 | Woodman | ..... | 52/664 |
| 5,018,332 | A * | 5/1991 | Ying-Kit | ..... | 52/666 |
| 5,185,982 | A * | 2/1993 | Hostetler | ..... | 52/646 |
| 5,487,345 | A * | 1/1996 | Winebarger et al. | ..... | 108/51.3 |
| 5,657,605 | A * | 8/1997 | Sidney | ..... | 52/664 |
| 7,665,270 | B1 * | 2/2010 | Moffly | ..... | 52/668 |
| 2007/0245638 | A1 * | 10/2007 | Lai | ..... | 52/79.1 |

* cited by examiner

*Primary Examiner* — Brian Glessner
*Assistant Examiner* — Brian D Mattei
(74) *Attorney, Agent, or Firm* — Vidas, Arrett & Steinkraus, P.A.

(57) ABSTRACT

Boat cabin construction, which can be built in significantly short time, is low cost and suitable for decorative modifications.

7 Claims, 9 Drawing Sheets

BOAT CABIN CONSTRUCTION

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The present invention relates to a boat cabin construction, which can be built in significantly short time, is low cost and suitable for decorative modifications.

Boat cabins comprise bottom wall, top wall and load-bearing lateral walls extending vertically between these so as to define a cubic geometry. Main structural components of the cabin walls, bottom and top walls are frame members.

Connections used in the cabin top wall construction are generally applied to beams and columns, which are resistant structural members in the boat frame. Preferably, interlocking joining and laminated methods are used in these joints. In fact, the procedure for closing the ceiling of cabin differs depending on the type of lining and joining means. In the so-called "laminated method", strength of connections relatively increases and in the case of wooden boats, deformation arising from wood defects is minimized.

Frame members are prepared according to the beam spacing for enclosing the cabin top wall and joining operation of the frame members are conducted by adjusting means in the working environment.

Lateral walls of the cabin generally comprise columns, frame members, filler materials and linings. Decorative features can be provided to the lateral walls by means of plywood placed in between frame members.

As might be expected from the above description, building of the existing cabin constructions is based on laying each frame member and placing plywood between them. However, such a construction is based substantially on labor and requires skill; therefore, it leads to spending substantial time and material loss.

On the other hand, in the construction of existing boat cabins, as the panels (usually plywood) placed between frame members are generally connected rigidly to the frame with an external connection member or placed based on their form, modification of these for decorative modification or functional purposes requires substantial human labor. Such a functional requirement is necessary when an apparatus (such as light fixture, power outlet, etc.) is to be installed. In fact, this issue is very important for a boat cabin where volume is limited and thus, modification inside the panels (between frame and panel) according to the needs is not desired or performed after construction of the boat cabin.

BRIEF SUMMARY OF THE INVENTION

An object of the present invention is to provide a boat cabin construction that can be built in a very short time and at low cost compared to their counterparts.

Another object of the present invention is to provide a boat cabin construction allowing for decorative modifications in an easy manner.

The present invention, to achieve objects thereof, relates to a boat cabin construction comprising a bottom wall and a top wall having a plurality of transversal frame members and a plurality of longitudinally extending elongate frame members, the elongate frame members engaging orthogonally to the transversal frame members, and vertically extending lateral walls between said bottom and top walls so as to be connected thereto. Each transversal frame member and each elongate frame member of the cabin construction according to the present invention comprises a plurality of engagement channels formed along their respective axes for inter-engaging said transversal frame members to respective elongate frame members; the height of said channels of each transversal frame member is equal to the difference between the height of the elongate frame member engaging to said channel and the height of the channel of the respective elongate frame member; and a connection member is provided at each engagement channel of each transversal frame member and/or at each engagement channel of each elongate frame member.

Furthermore, boat cabin construction according to the present invention comprises a plurality of panels mounted to the transversal and elongate frame members. These panels can be mounted to the transversal and elongate frame members so as to preferably face the inner part of the cabin construction by means of detachable connection members. Thus, each panel can be easily detached from respective frame members if desired.

DETAILED DESCRIPTION OF THE INVENTION

Figure 1:
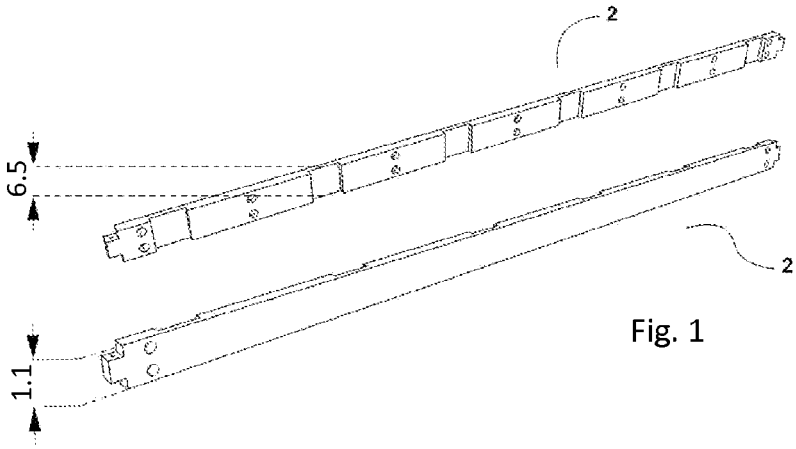
FIG. 1 shows perspective front and rear view of one of the frame members forming the bottom of the cabin construction positioned on the lower side.
Figure 1A:
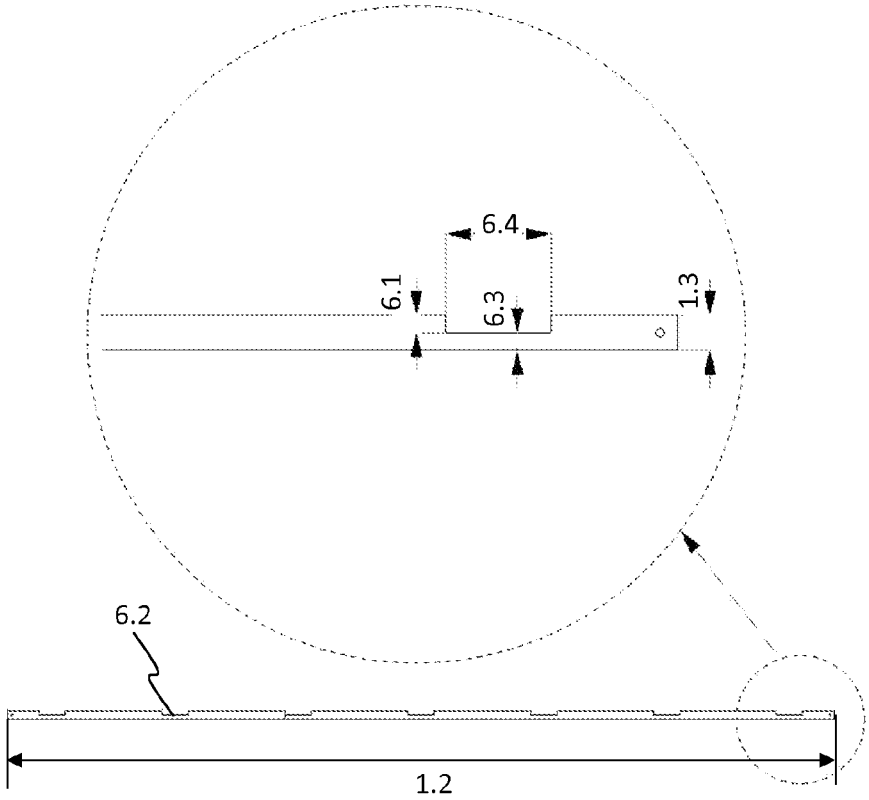
FIG. 1A shows front view of a frame member.
Figure 2:
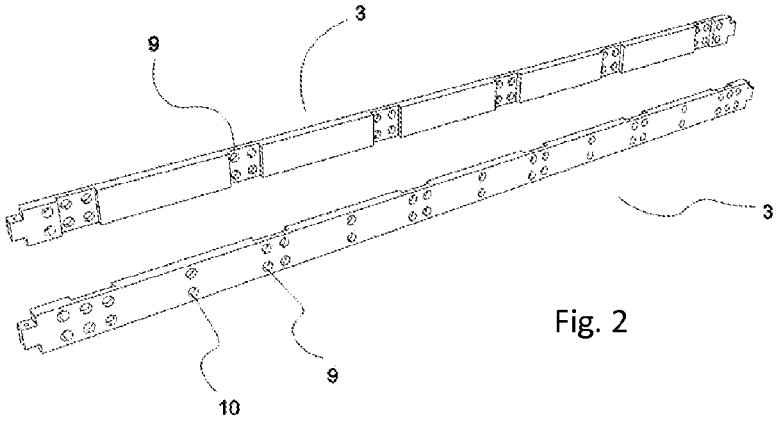
FIG. 2 shows perspective front and rear view of one of the frame members forming the bottom wall of the cabin construction positioned on the upper side.

While this invention may be embodied in many different forms, there are described in detail herein a specific preferred embodiment of the invention. This description is an exemplification of the principles of the invention and is not intended to limit the invention to the particular embodiment illustrated General geometric form of the boat cabin construction according to the present invention is cubic (or similar prismatic form) and it comprises a bottom wall (12) extending horizontally, a top wall (13) located at a certain distance above said floor portion and lateral walls (14) vertically extending between the bottom wall (12) and the top wall (13).

Each constituent portion forming the boat cabin construction, i.e. top wall (13), bottom wall (12), and lateral walls (14), comprises a plurality of inter-engaging transversal frame members (2) and elongate frame members (3). Each frame member (2, 3) has an elongated plank-like form and each frame member has a width (1.1), a length (1.2) and a height (1.3).

Each frame member (2, 3) is provided with a plurality of channels (6) formed along respective longitudinal axis thereof. Channels (6) are formed on at least one surface of each frame member (2, 3) and along width (1.1) thereof (i.e. along the whole width thereof). Each channel (6) has a certain height (6.1) and said "height", in this description, refers to the distance between respective surface of the frame member where channel is formed and base of the channel (6.2). The distance between the base of the channel (6.2) and the opposite surface of the frame member (where channel is not formed) is equal to the difference between frame member height and channel height (6.3). According to the preferred embodiment of the present invention, channel height (6.1) is equal to the difference between the frame height and the channel height (6.3). Frame member surfaces without channels (6) are preferably planar (recess- or protrusion-free).

Channel (6) cavities comprise a prismatic geometric form and channel base (6.2) plane is preferably parallel to the external surfaces of the frame member. Engaging of each frame member to the other frame member is provided by means of inter-engaging of respective channels of each frame member and then utilization of a connection member.

Frame members (2, 3) inter-engage orthogonally. For instance, horizontal and vertical frame members (2, 3) forming the lateral walls (14) inter-engage such that transversal frame member (2) remains below and elongate frame member (3) remains above said transversal frame member (2) and respective channels are orthogonal to each other. For said engagement and panel (15) connections made to frame members, as will be explained below, to be perfect, channel height (6.1) of each transversal frame member (2) channel (6) is equal to the difference (6.3) between the height (1.3) of the elongate frame member (3) engaging to said channel (6) and the height (6.1) of the channel (6) of the respective transversal frame member.

On the other hand, each channel length (6.4) formed on each frame member, said "length" referring to channel dimension parallel to the axis of the frame member, is equal or substantially equal to the width (6.5) dimension of the frame member channel engaging to said frame member. "Channel width" and width (1.1) dimension of the frame member are equal or substantially equal. According to a preferred embodiment of the present invention, length (6.4) of each channel and height (1.3) of each respective frame member have identical dimensional values.

Frame members (2, 3) are preferably made of wood, wherein said members can also be made of various types of materials such as plastics, fiber-reinforced plastics, metals, composites, etc. When wood material is selected for the frame members (2, 3), said members can be produced rapidly by means of preferably a numerically controlled machine tool (such as CNC milling machine). In this sense, forming of the channels (6) with precise dimensions is easily obtained.

Transversal and elongate frame members (2, 3) are inter-engaged by means of a connection member (4) after being fit to each other through respective channels (6) thereof. Said connection member (4) can be any mountable and demountable connection member known in the current state of the art (e.g. "PC-01" panel clip set supplied commercially by Fastmount Ltd. or other connection members having similar function). At least some frame members (2, 3) comprise connection slots (9) provided in the channel (6) portions thereof for the connection members to be placed to the portions where channels (6) of the frame members (2, 3) are provided. These (9) slots are preferably formed along the whole channel width (difference between the frame height and the channel height (6.3)).

Each frame member (2, 3) is provided with further/other connection slots (9). Said slots (9) are provided for placing the connection members (4), which are required for mounting the panels (15) to the frame members (2, 3), therein. Means used for engagement between frame members (2, 3) and panels (15), can be any mountable and demountable connection member known in the current state of the art (e.g. "PC-01" panel clip set supplied commercially by Fastmount Ltd. or other connection members having similar function).

Panels can be made of materials such as wood, i.e. plywood, plastic, etc. and any panel (15) mounted to the frame member (2, 3) can be replaced with a new one or with a panel covered with a different decorative coating by being easily demounted therefrom. Panels (15) are mounted to the frame members so as to face the inner volume of the cabin. Moreover, respective panel (15) can be easily demounted for fitting functional components such as light fixture, power outlet, etc. in the rear part of the panel (15) that cannot be seen, i.e. the space between frame members (2, 3). In addition, if desired, a noise and/or heat insulating material can also be fitted in the rear portion of the panels (15) (the space between frame members (2, 3)).

Figure 3:
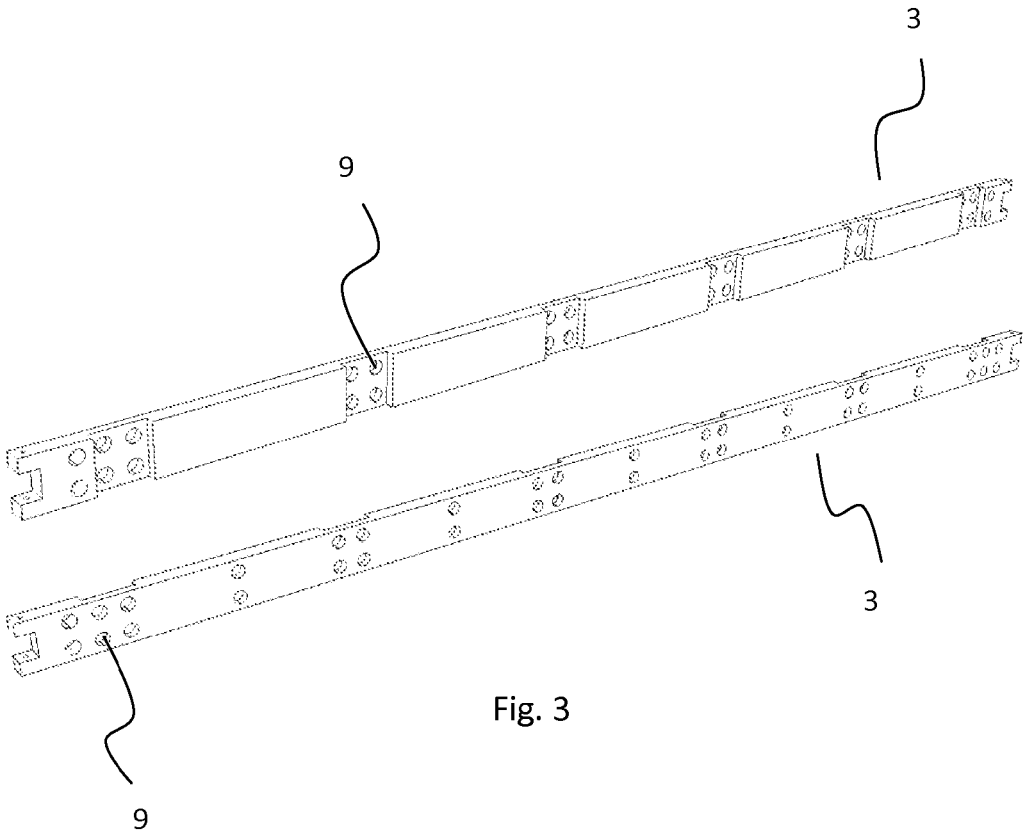
FIG. 3 shows perspective front and rear view of one of the frame members forming the top wall of the cabin construction positioned on the lower side.
Figure 4:
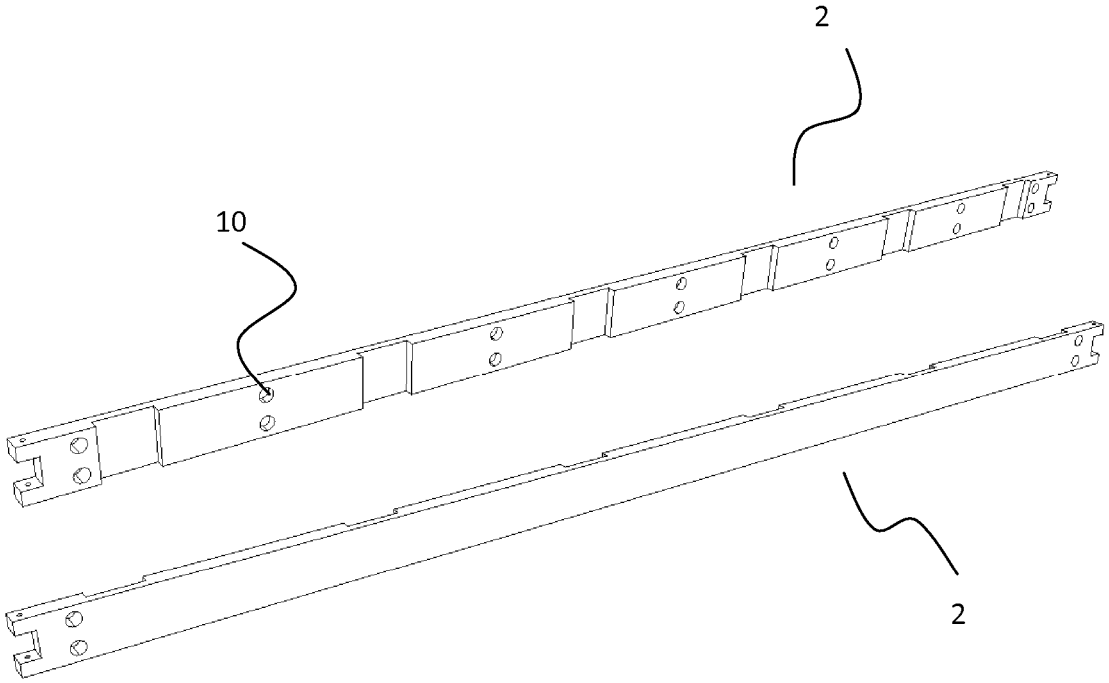
FIG. 4 shows perspective front and rear view of one of the frame members forming the top wall of the cabin construction positioned on the upper side.
Figure 5:
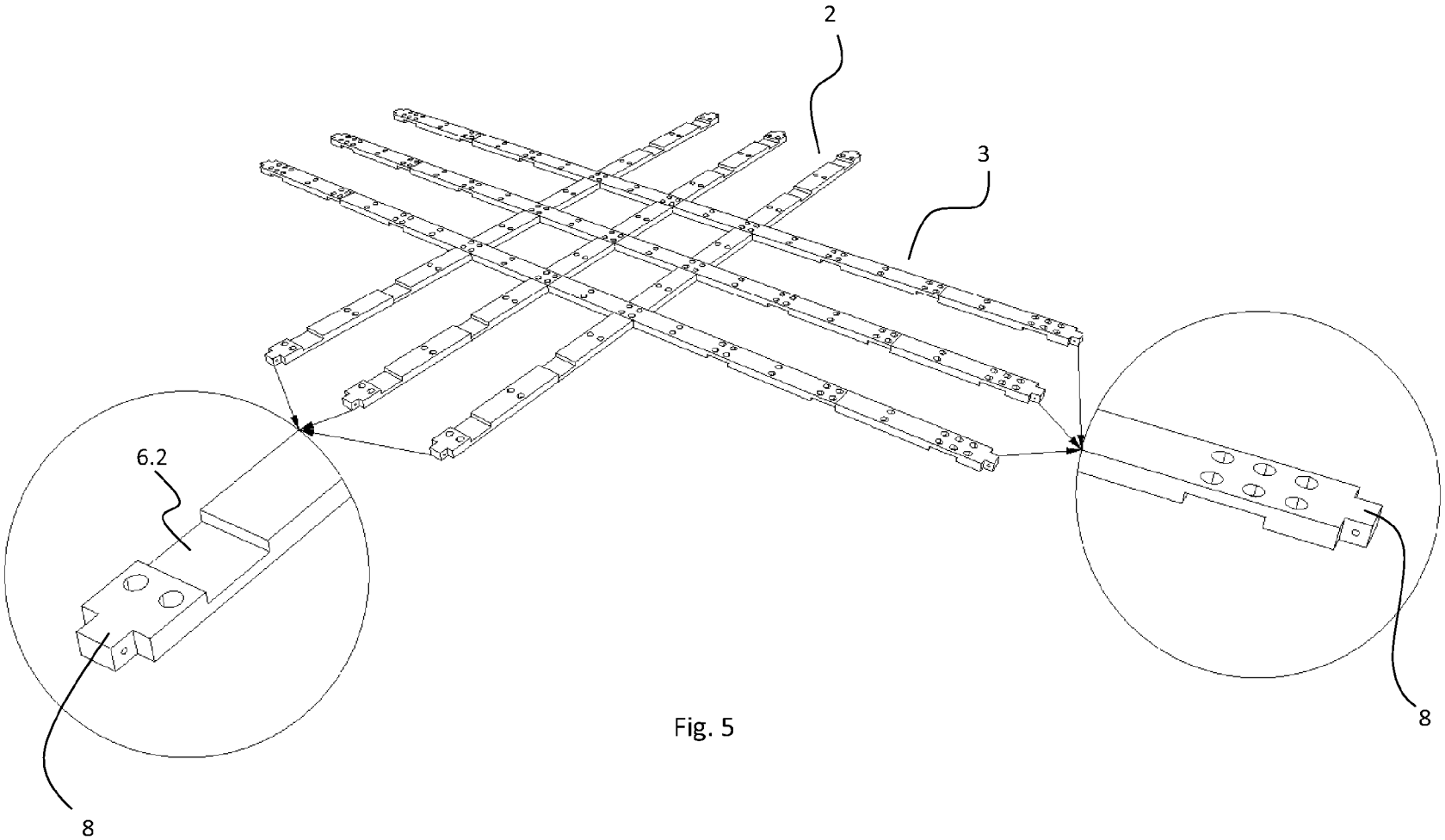
FIG. 5 shows perspective view of several inter-engaged frame members for forming the bottom wall of the cabin construction.
Figure 6:
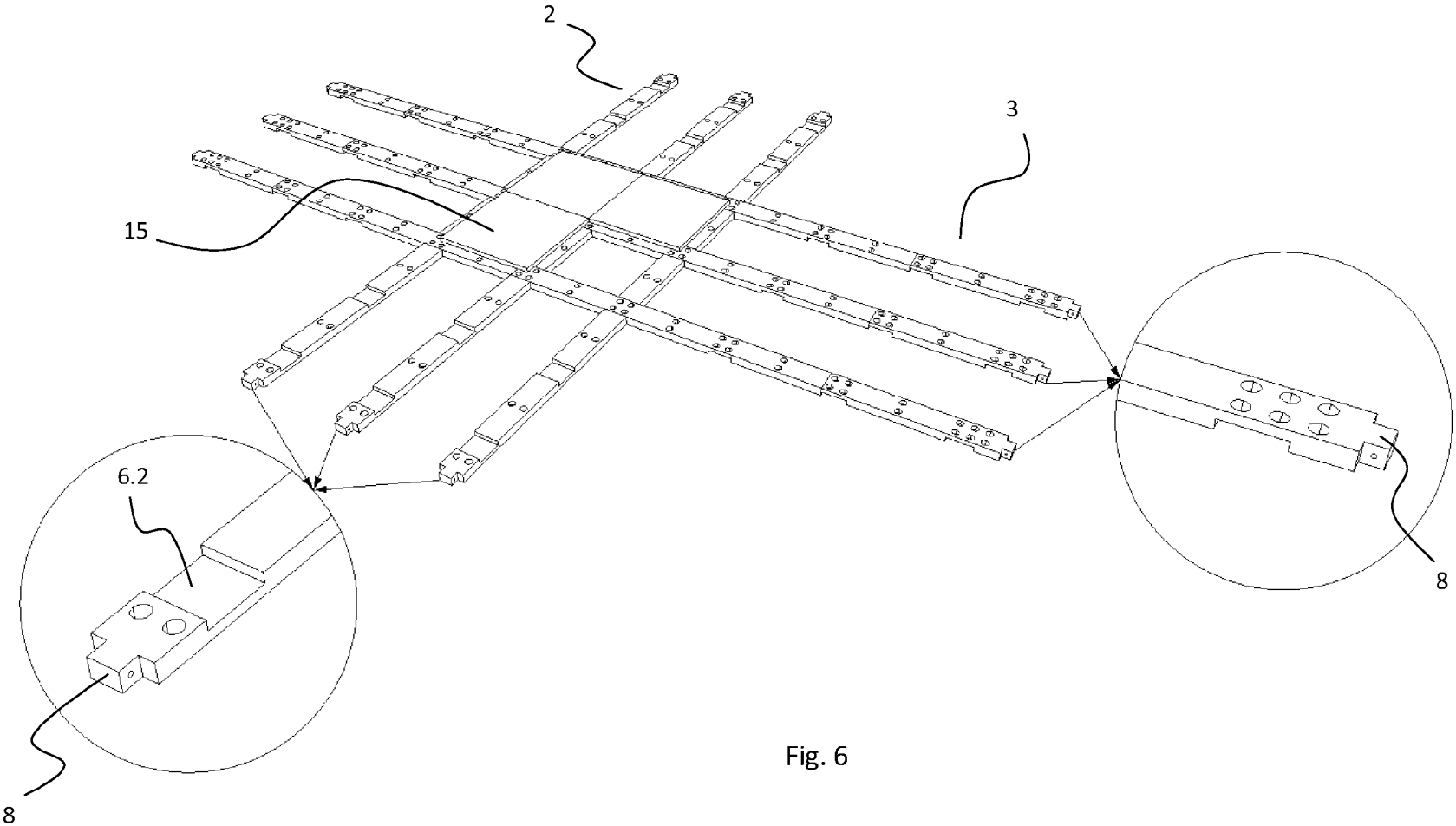
FIG. 6 shows perspective view of the structure in FIG. 5 with panels.
Figure 6A:
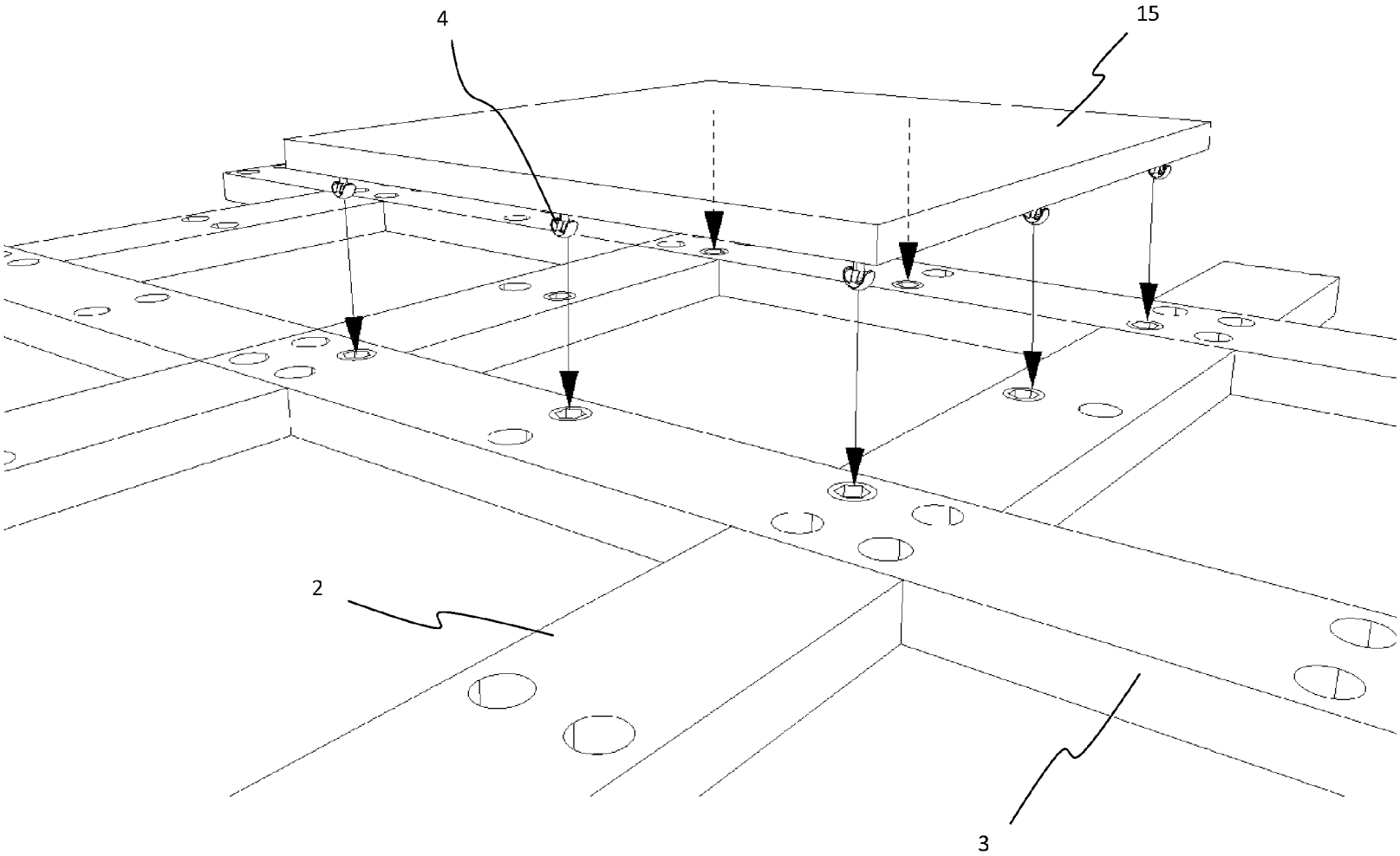
FIG. 6A shows close-up perspective view of the attached panel in FIG. 6.
Figure 7:
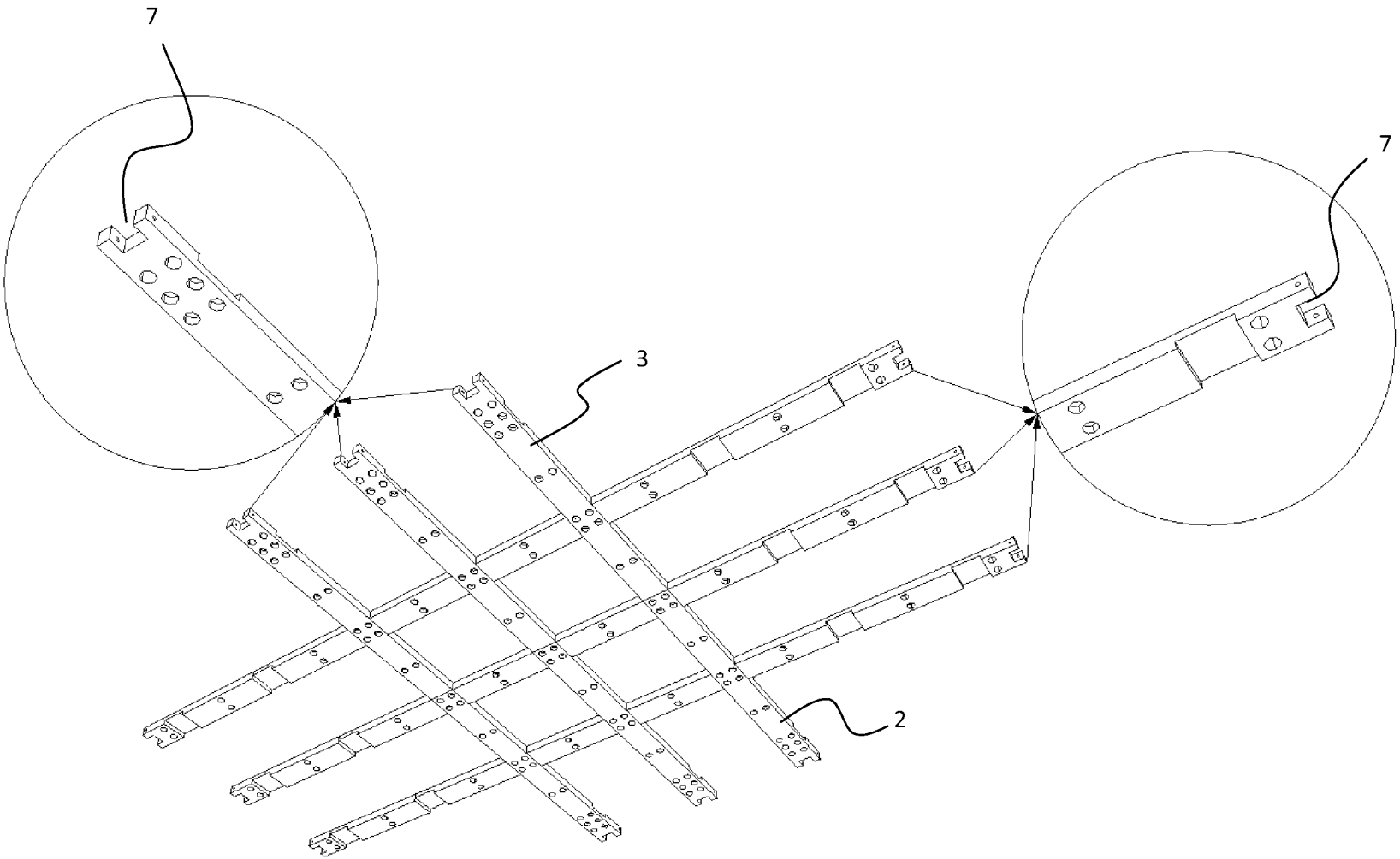
FIG. 7 shows perspective view of several inter-engaged frame members for forming the top wall of the cabin construction.
Figure 8:
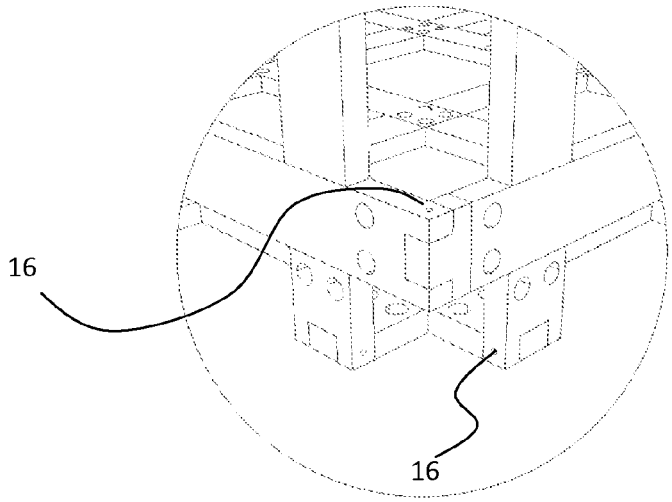
FIG. 8 shows detailed view of the corner connection of the frame members forming the cabin construction.
Figure 9:
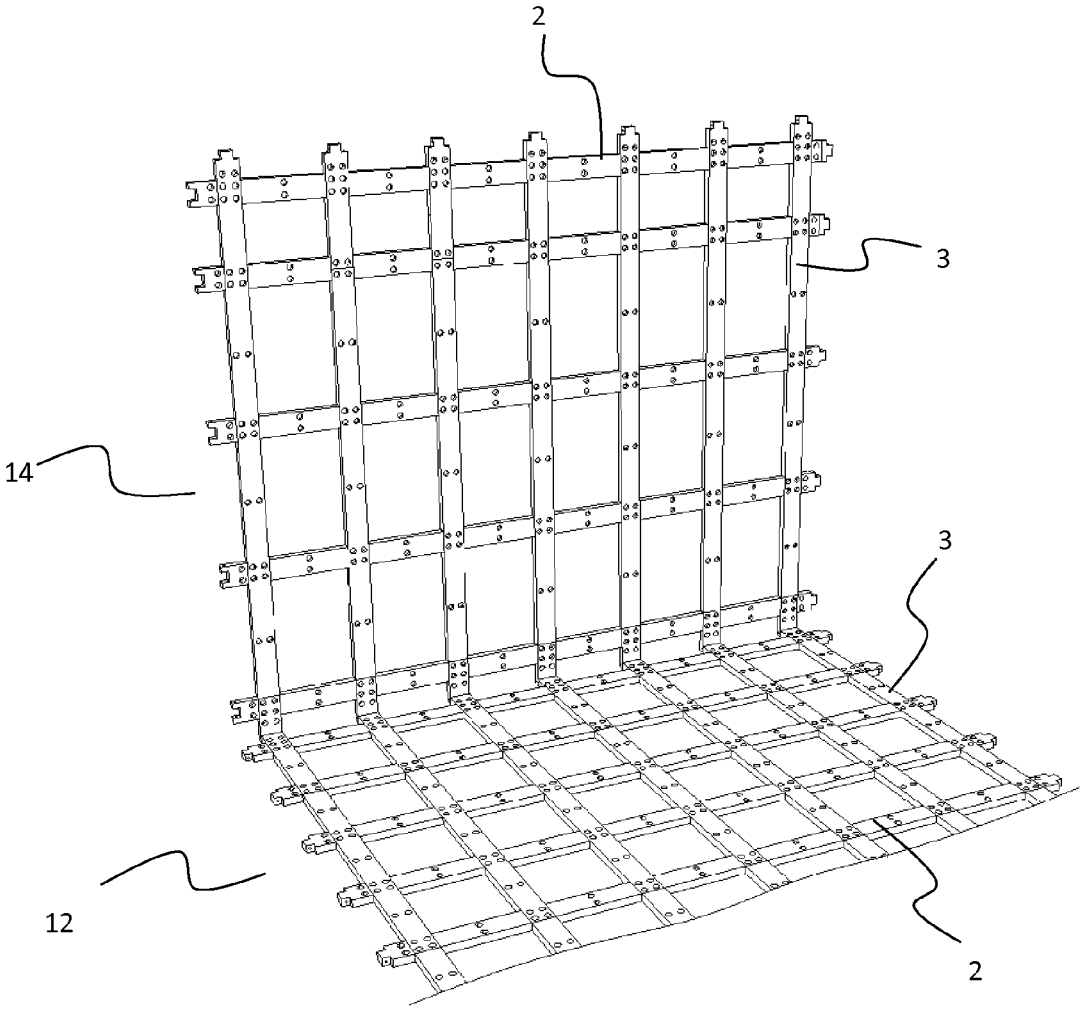
FIG. 9 shows perspective view of the interconnected bottom wall and top wall for forming the cabin construction.
Figure 10:
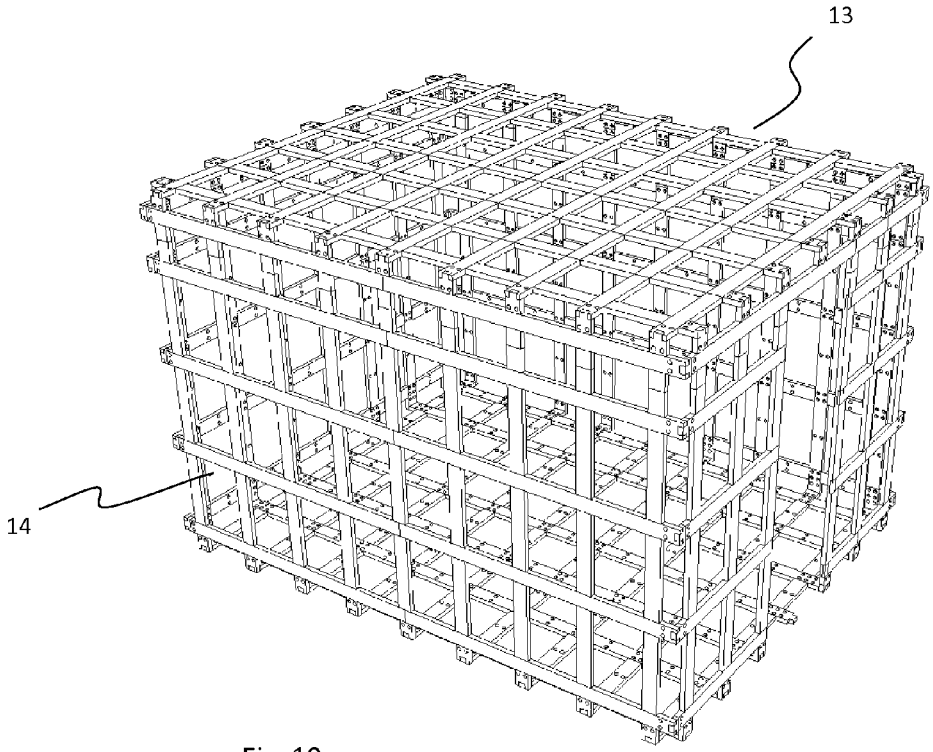
FIG. 10 shows perspective view of the interconnected bottom, top and lateral walls forming the cabin construction.
Figure 11:
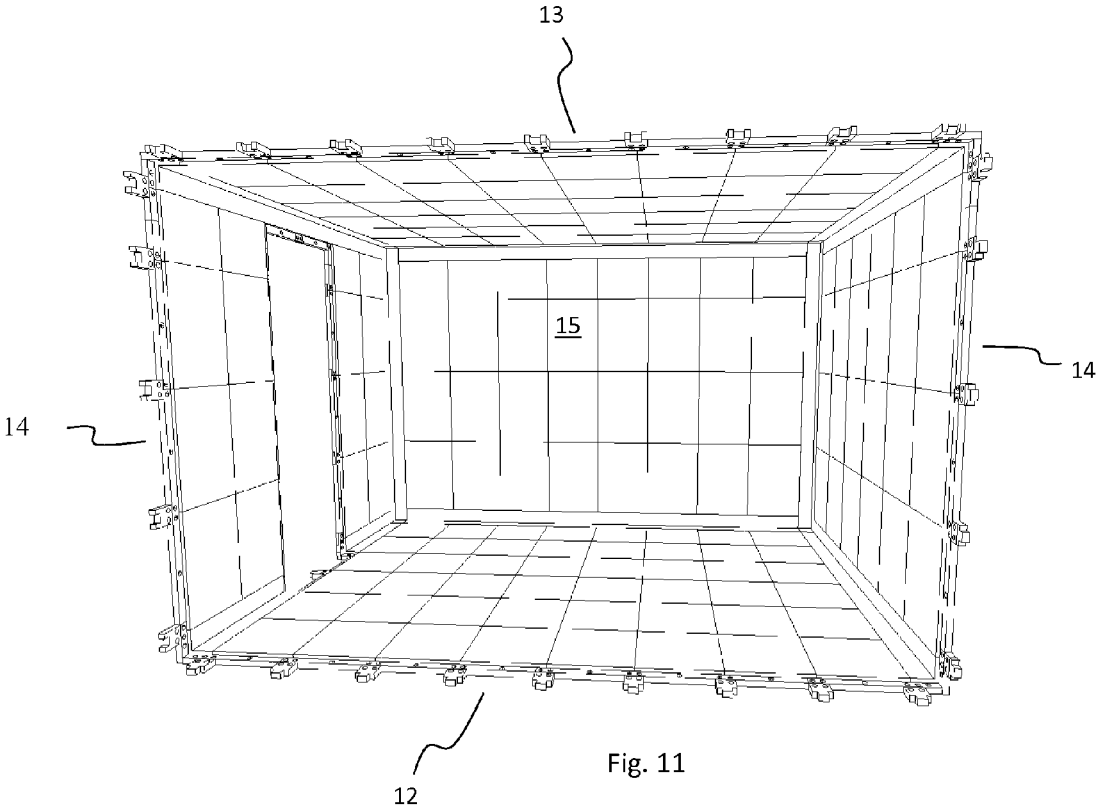
FIG. 11 shows perspective view of the interconnected bottom, top and lateral walls forming the cabin construction with the panels attached.
Figure 12:
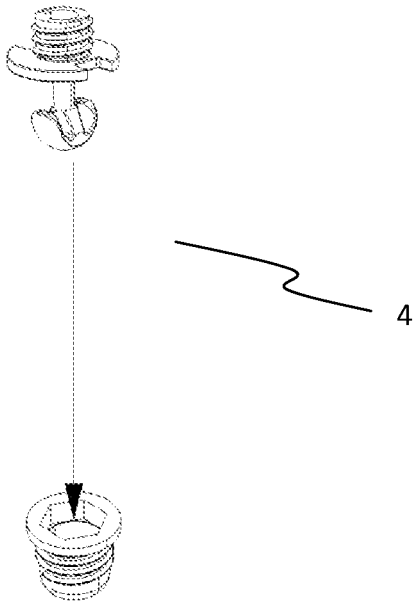
FIG. 12 shows perspective view of a connection member according to the present invention.

Male (8) and/or female connections (7) are formed at the ends of each frame member for being able to connect frame members (2, 3) of the lateral walls (15) to frame members (2, 3) of the ceiling portion (13) and floor portion (12). Depending on the availability of connection to be made, as can be seen in FIG. 3, both ends of some frame members can be female, or, as can be seen in FIG. 1, both ends of some frame members can be male, or, as can be seen in FIG. 9, one end of some frame members can be female and the other end thereof can be male. Respective female and male ends (7, 8) of the frame members are joined together for connection and said connection can be provided by means of a fitting member such as a pin or a bolt. Thus, fitting member holes (16) are formed in said female and male ends (7, 8).

This completes the description of the preferred and alternate embodiments of the invention. Those skilled in the art may recognize other equivalents to the specific embodiment described herein which equivalents are intended to be encompassed by the claims attached hereto.

What is claimed is:

1. A boat cabin construction comprising:

a bottom wall and a top wall having a plurality of transversal frame members and a plurality of longitudinally extending elongate frame members;

a plurality of panels removably mounted to the transversal and elongate frame members;

the elongate frame members engaging orthogonally to the transversal frame members, and vertically extending lateral walls between said bottom and top walls so as to be connected thereto, wherein each transversal frame member and each elongate frame member of the cabin construction comprises a plurality of engagement channels formed along their respective axes for inter-engaging said transversal frame members to respective elongate frame members;

wherein each transversal frame member and each elongate frame member is spaced from one another;

wherein the height of said channels of each transversal frame member is equal to the difference between the height of the elongate frame member engaging to said channel and the height of the channel of the respective elongate frame member; and wherein, at least one connection member is provided at each engagement channel of each transversal frame member and/or at each engagement channel of each elongate frame member.

2. A boat cabin construction according to claim 1, wherein each channel length formed on each frame member is equal or substantially equal to the width dimension of the frame member channel engaging to the said frame member.

3. A boat cabin construction according to claim 1, wherein channels are formed on at least one surface of each frame member and along width thereof with frame member surfaces without channels being planar.

4. A boat cabin construction according to claim 1, wherein channel cavities comprise a prismatic geometric form.

5. A boat cabin construction according to claim 1, wherein at least some frame members comprise connection slots formed in the channel portions thereof for inter-engaging frame members by connection members.

6. A boat cabin construction according to claim 1, wherein frame members are made of a material comprising wood or plastic or fiber-reinforced plastic or metal or composite.

7. A boat cabin construction according to claim 1, wherein ends of each frame member are in the male or female form.

* * * * *